US007243418B2

(12) United States Patent
Murillo, Jr. et al.

(10) Patent No.: US 7,243,418 B2
(45) Date of Patent: Jul. 17, 2007

(54) APPARATUS AND METHOD FOR OPENING A SEALED MODULE CONTAINING A CIRCUIT BOARD

(75) Inventors: Tomas Murillo, Jr., El Paso, TX (US); Francisco Chairez, El Paso, TX (US); Jose Monreal, Ciudad Juarez Chihuahua (MX)

(73) Assignee: Cummins, Inc., Columbus, IN (US)

( * ) Notice: Subject to any disclaimer, the term of this patent is extended or adjusted under 35 U.S.C. 154(b) by 339 days.

(21) Appl. No.: 10/872,790

(22) Filed: Jun. 22, 2004

(65) Prior Publication Data

US 2005/0278925 A1 Dec. 22, 2005

(51) Int. Cl.
*B25B 27/14* (2006.01)

(52) U.S. Cl. ..... 29/762; 29/256; 29/257

(58) Field of Classification Search ..... 29/256–266, 29/762–764, 758–760; 100/214, 230, 233, 100/295

See application file for complete search history.

(56) References Cited

U.S. PATENT DOCUMENTS 1,451,852 A * 4/1923 Verdoorn ..... 29/227
4,597,173 A 7/1986 Chino et al.
4,615,208 A * 10/1986 Hailey ..... 72/455
5,062,201 A 11/1991 Long, Jr.
5,152,052 A 10/1992 Rantala et al.
5,295,841 A * 3/1994 Grabbe et al. ..... 439/73
5,837,556 A 11/1998 Ostendorf et al.
5,842,261 A 12/1998 Ortiz
6,068,727 A 5/2000 Weaver et al.
6,192,570 B1 2/2001 Traver et al.
6,497,026 B1 12/2002 Traver et al.
2003/0229979 A1 12/2003 Kappel et al.

FOREIGN PATENT DOCUMENTS

EP 0 349 133 A1 1/1990

* cited by examiner

*Primary Examiner*—Peter Vo
*Assistant Examiner*—Livius R. Cazan
(74) *Attorney, Agent, or Firm*—Nixon Peabody LLP; Tim L. Brackett, Jr.; J. Bruce Schelkopf

(57) ABSTRACT

An apparatus and method is provided which permits effective removal of a circuit board from sealed housing while minimizing stress, bending and flexing of circuit board sufficiently to prevent damage to circuit board and its electronic components. The apparatus includes a base to support the housing and a force transmitter to transmit a separation force to the exposed surfaces of one or more connectors of the circuit board. This apparatus effectively distributes the separation force across exposed surfaces of the connectors to create substantially uniform pressure on the connectors and thus the circuit board. The invention also includes steps for separating the circuit board from the housing including, in one embodiment, a separator apparatus for applying a pulling force to the connectors of the circuit board.

21 Claims, 6 Drawing Sheets

FIG.11
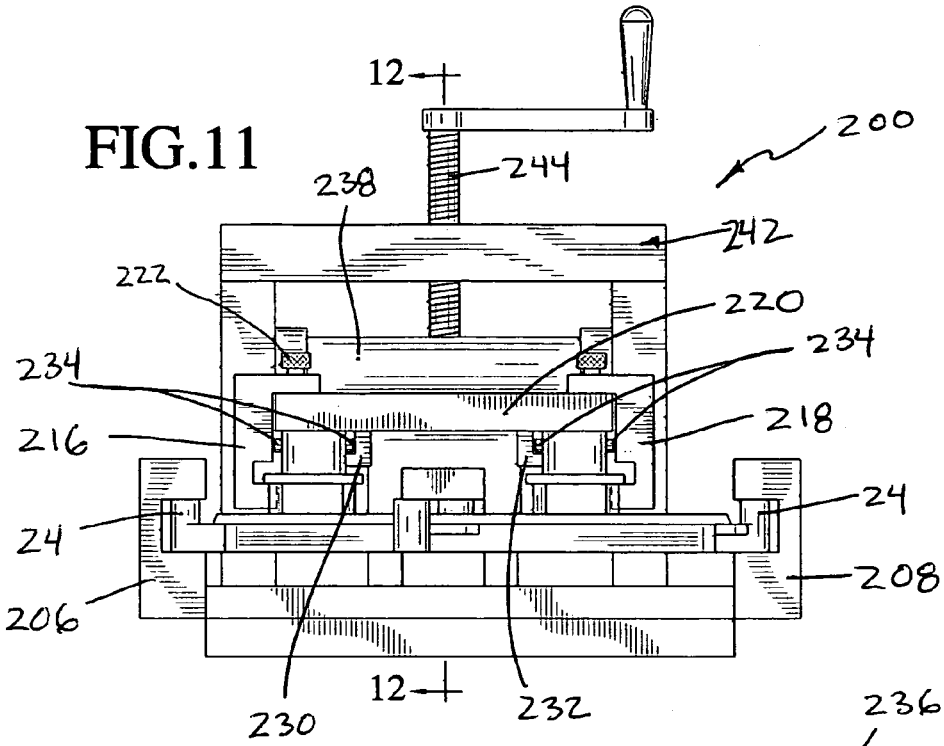
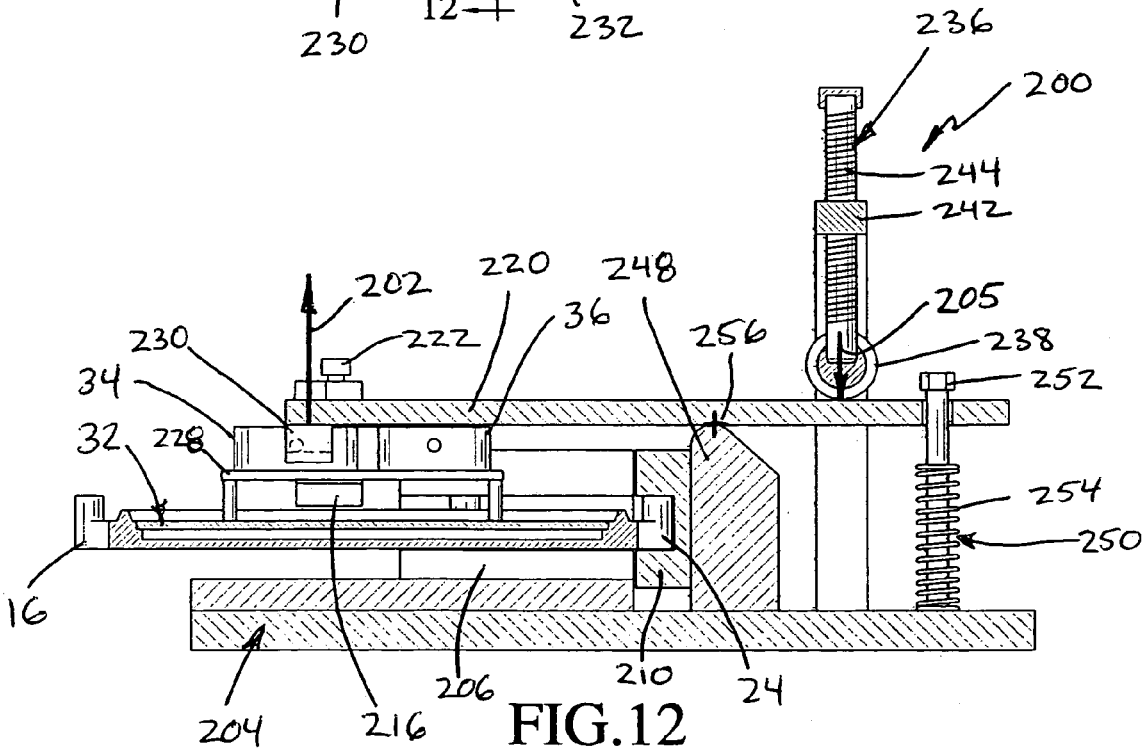
FIG.12

APPARATUS AND METHOD FOR OPENING A SEALED MODULE CONTAINING A CIRCUIT BOARD

BACKGROUND OF THE INVENTION

1. Technical Field

This invention relates to the remanufacture of electronic control modules, such as for use with electronically controlled engines. In particular, the invention relates to an apparatus and method for opening a sealed module containing a circuit board and removing the circuit board.

2. Description of Related Art

Most modern internal combustion engines have some form of electronic controller that governs the operation of the engine. In the case of larger vehicles, a substantial engine control module is provided that performs a wide range of functions. For example, the module provides signals via an electrical harness to various electrical components throughout the engine and vehicle. In addition, the module receives signals from a number of sensors disposed at various locations throughout the engine.

For example, as shown in FIG. 1, an engine control module (ECM) 10 includes a housing 12 formed of a first section 14 and a second section 16. First section 14 includes securing holes 18 (FIG. 4) formed in either a peripheral flange 20 extending along an outer peripheral portion of the housing or bosses extending from peripheral flange 20. Second section 16 includes securing holes 22 (FIG. 9) formed at different locations around its periphery for alignment with securing holes 22 of first section 14. Screws 21 extend through securing holes 18 and 22 to secure first section 14 and second section 16 together. Second section 16 also includes a peripheral flange 23 including a number of bosses 24 extending from its periphery which contain mounting holes 26 for receiving bolts (not shown) for mounting ECM 10 to an engine. An adhesive or sealant bead 30 (FIG. 9) is positioned between flange 20 and the opposing face of second section 16 for bonding and sealing the sections together. The bead material is normally capable of bonding metal-to-metal, while withstanding the high temperatures experienced in the engine compartment, such as an RTV material.

Housing 12 is formed of a rigid material, such as a metal, for example, aluminum, by, for example, a die cast process. Outer dimensions of housing 12 are generally sized to be slightly larger than a circuit board 32 positioned within housing 12. Referring to FIGS. 1 and 9, circuit board 32 functions as a substrate on which is mounted various electronic components 31, such as resistors, capacitors, transistors, microprocessors, memory devices, etc. Circuit board 32 is formed of a rigid material, i.e. fiberglass, and securely mounted on second section 16 of housing 12. Second section 16 includes a raised wall 33 (FIG. 8) extending peripherally around second section 16 to form a recess 35 for receiving circuit board 32. Circuit board 32 further includes a first connector 34, a second connector 36 and a third connector 38, securely mounted on a top face 40 of board 32 and extending outwardly from top face 40 for engaging respective cables or harnesses (not shown) to link the electronic and microprocessor components of the ECM 10 to the various sensors and engine control devices. First section 14 of housing 12 includes a first opening 44 for receiving first and second connectors 34 and 36 and a second opening 46 for receiving connector 38.

While ECM 10 provides an environmentally sound and sealed module, difficulties arise when the module must be remanufactured. This remanufacturing process may be required when there is an update to some of components 31 mounted on circuit board 32. In other instances, direct diagnosis of the components is necessary due to component malfunctioning or failure which requires access to circuit board 32. In the absence of remanufacturing, ECM 10 is simply disposed of, and replaced with a new module. Of course, this approach often unnecessarily wastes resources, including especially the circuit board and electronic components, and can lead to delays where the module is difficult to obtain. Moreover, electronic components and related soldering materials may contain hazardous materials thereby requiring treatment as hazardous waste and thus increasing the costs of disposal. Prior attempts to open housing 12 have resulted in irreparable damage to rigid circuit board 32 and/or electronic components 31, rendering the circuit board unusable.

U.S. Pat. No. 5,837,556 to Ostendorf et al. describes a method of removing adhesively bonded components from a substrate using screws located in bores beneath the component. As the screws are turned, the force is transferred to the component through a ball bearing to a cylindrical pin which ultimately pushes against the component and moves the component away from the substrate.

U.S. Pat. No. 6,068,727 to Weaver et al. describes prior art which includes a method of removing a stiffener from a substrate by using a thin wedge, such as a razor blade, to cut through an adhesive layer, and then prying the stiffener off the substrate.

U.S. Pat. Nos. 6,497,026 and 6,192,570 issued to Traver et al. discloses a method for opening a sealed engine control module containing a flexible circuit board by using a fixture for supporting the module as the module is unbent into an open position. The method includes first machining the edges of the module housing to expose a sealing bead, then disrupting the sealing bead around the housing by machining, cutting or the use of wedges and finally positioning of the module in the fixture and bending into the open position.

Thus there is a need for an apparatus and method for the remanufacturing, and specifically opening and disassembling, of a sealed module, which simply and effectively permits the opening of the module housing and removal of a circuit board while maintaining the integrity and reusability of the circuit board and electronic components.

SUMMARY OF THE INVENTION

One advantage of the present invention is to permit remanufacturing of sealed electronic control modules.

Another advantage of the present invention is to permit warranty analysis, reliability and durability studies, troubleshooting, repair and/or replacement of electronic components on a circuit board contained in a sealed module.

Still another advantage of the present invention is to lower the cost of providing an operable electronic control module for an engine upon the malfunction and removal of an existing module.

Yet another advantage of the present invention is to minimize the scrapping of circuit boards and components that function properly.

Another advantage of the present invention is the simple and effective opening of a sealing module containing a circuit board without damaging the circuit board and the components mounted on the circuit board.

Still another advantage of the present invention is to minimize flexing of the circuit board in a sealed module during opening of the module.

Another advantage of the present invention is the simple and effective complete removal a circuit board from a sealed housing.

These and other advantages and features of the present invention are achieved by providing an apparatus for opening a sealed module having a sealed housing formed of a first section and a second section sealingly connected to the first section, and a circuit board mounted on the second section within the housing, the circuit board including at least one connector having an exposed surface accessible from outside the housing, wherein the apparatus comprises a base adapted to support the first section of the module housing and a force transmitter adapted to transmit a separation force to the exposed surface of the at least one connector to separate the second section from the first section. The force transmitter includes at least one transmitting surface sized and shaped to distribute the separation force across the exposed surface of the at least one connector to create substantially uniform pressure on the exposed surface of the connector. The base may include a plurality of support surfaces positioned to support only an outer peripheral flange of the first section. The at least one transmitting surface may be sized and shaped to substantially correspond to a size and shape of the at least one connector. The at least one transmitting surface may include a plurality of transmitting surfaces positioned a spaced distance from one another to apply the separation force to a plurality of connectors. The plurality of transmitting surfaces may be equal in number to a total number of connectors. The base may also includes a bottom wall and a side wall extending from the bottom wall, wherein the side wall has an upper support surface to support an outer flange of the first section of the housing. The force transmitter may include a cross plate for receiving the separation force, a first arm extending from the cross plate and a second arm extending from the cross plate a spaced distance from the first arm. The first and second arms may extend from one face of the cross plate. The force transmitter may have a U-shaped cross-section. The force transmitting surface may contact at least two sides of the at least one connector. A force applicator may be provided to apply a force to the force transmitter.

The present invention is also directed to a method of opening a sealed module having a sealed housing formed of a first section and a second section sealingly connected to the first section, and a circuit board mounted on the second section within the housing, wherein the circuit board includes at least one connector having an exposed surface accessible from outside the housing. The method includes the steps of supporting the first section of the module housing and applying the separation force to the exposed surface of the at least one connector and distributing the separation force across the exposed surface of the at least one connector to cause the second section of the housing to separate from the first section while preventing damage to the circuit board. The method may include the step of machining the second section of the housing along an edge of the second section to expose a joint between the second section and the circuit board, and further inserting a tool into the joint between the second section and the circuit board to separate the circuit board from the second section. The step of supporting the first section may include supporting the first section only at and along a peripheral flange of the first section. The method may also include the step of providing a force transmitter including at least one transmitting surface sized and shaped to substantially correspond to a size and shape of the at least one connector. Both the apparatus and the method of the present invention may include a plurality of connectors, each having an exposed surface for the application of the separation force. The separation force may be applied to exposed surfaces on each of two sides of each of connector. The method may further include the steps of holding a peripheral flange of the second section of the housing and applying a pulling force to the connector to separate the circuit board from the second section.

BRIEF DESCRIPTION OF THE DRAWINGS

FIG. 11 is an end view of the separator apparatus of FIG. 10 with the circuit board and housing section installed;

FIG. 12 is a cross sectional view taken along lines 6—6 in FIG. 11;

DETAILED DESCRIPTION OF THE INVENTION

Figure 3:
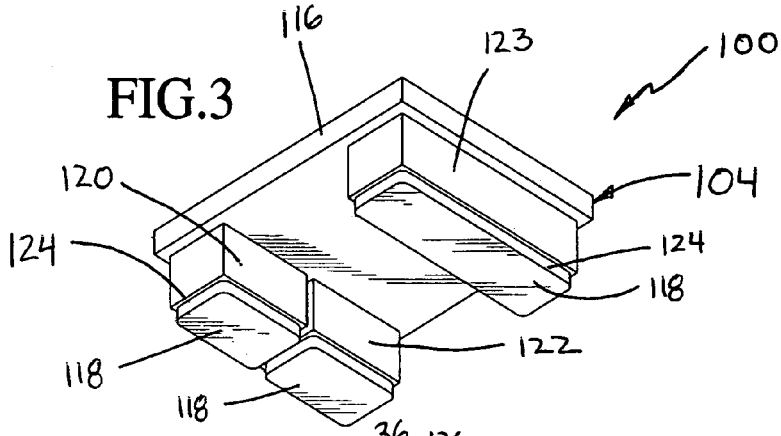
FIG. 3 is a perspective view of the force transmitter of the apparatus of the present invention.

The present invention is directed to an apparatus or a fixture for opening a sealed module, such as electronic control module (ECM) 10 (FIG. 1), and a corresponding method for opening a sealed module and preferably also separating the circuit board 30 (FIG. 9) from the housing 12 of module 10. As shown in FIGS. 2 and 3–6, apparatus 100 for opening housing 12 generally includes a base 102 for supporting housing 12 of ECU 10, a force transmitter 104 for transmitting a separation force to housing 12 to effect separation of the housing as discussed hereinbelow, and a force applicator 106. The method of the present invention effectively opens sealed housing 12 of ECU 10 using a separation force applied in a manner described in detail hereinbelow and separates the circuit board 32 from housing 12 while preventing damage to circuit board 32 throughout the process.

Figure 2:
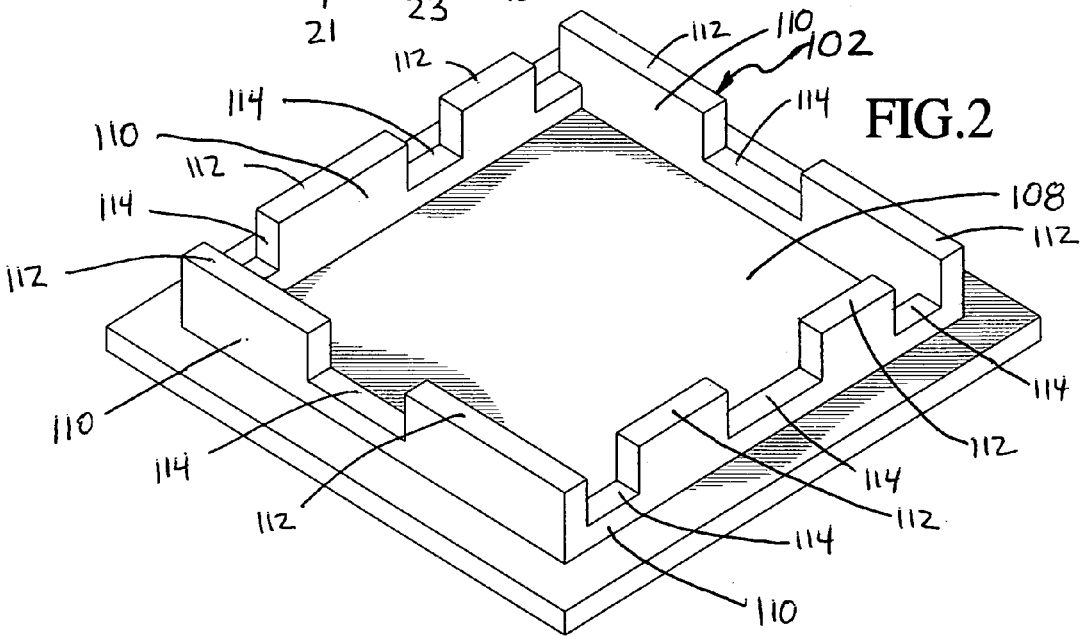
FIG. 2 is a perspective view of the base of the apparatus of the present invention.
Figure 4:
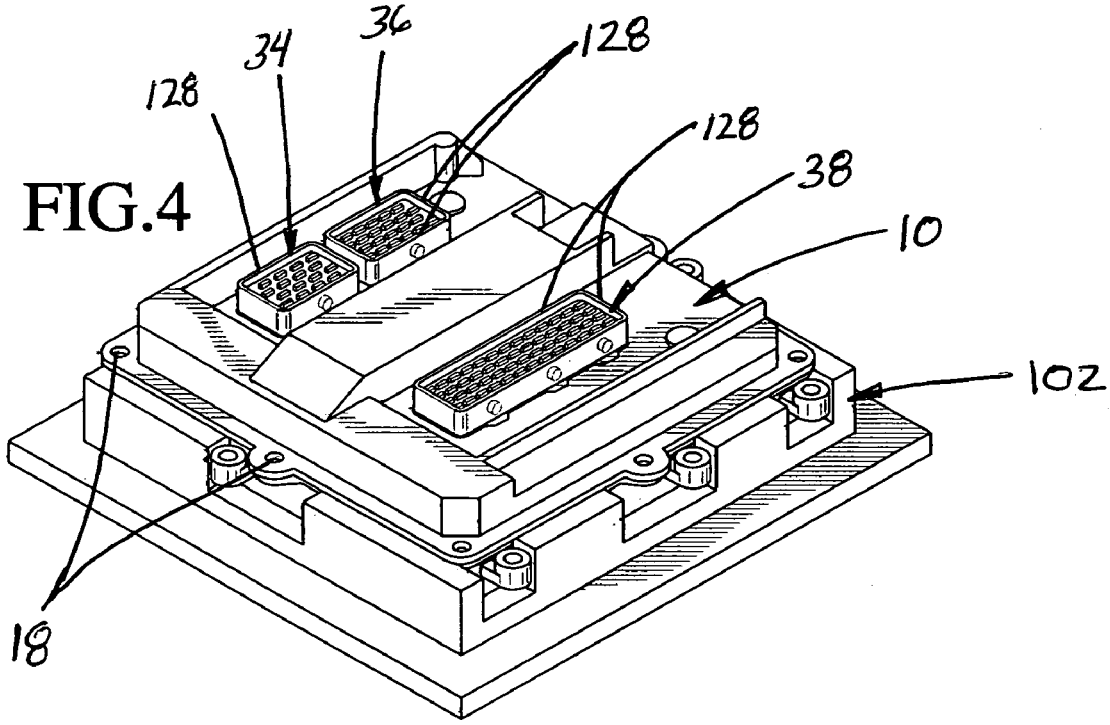
FIG. 4 is a perspective view of the electronic control module supported by the base of the apparatus of the present invention.

In an exemplary embodiment of the present invention as shown in FIG. 2, base 102 of apparatus 100 includes a bottom plate or wall 108 and four side walls 110 extending upwardly from bottom wall 108. The side walls 110 each include one or more upper support surfaces 112 for supporting first section 14 of housing 12. Specifically, side walls 110 are shaped and positioned to support the outer peripheral flange 20 of first section 14 as shown in FIG. 4. Side walls 110 may be any shape and in any position which effectively supports an appropriate portion of first section 14 of housing 12 to permit separation of second section 16 from first section 14 when a separation force is applied as described hereinbelow. Side walls 110 include recesses 114 positioned in alignment with bosses 24 of second section 16 such that circuit board 32 can be positioned between side walls 110 with support surfaces 112 in abutment with flange 20 without bosses 24 interfering with the abutment. In addition, recesses 114 are formed with a sufficient depth such that bosses 24 are positioned a spaced distance in the vertical direction as shown in FIG. 2 from the bottom of recesses 114 to permit movement of second section 16 downwardly during separation from first section 14.

Figure 5:
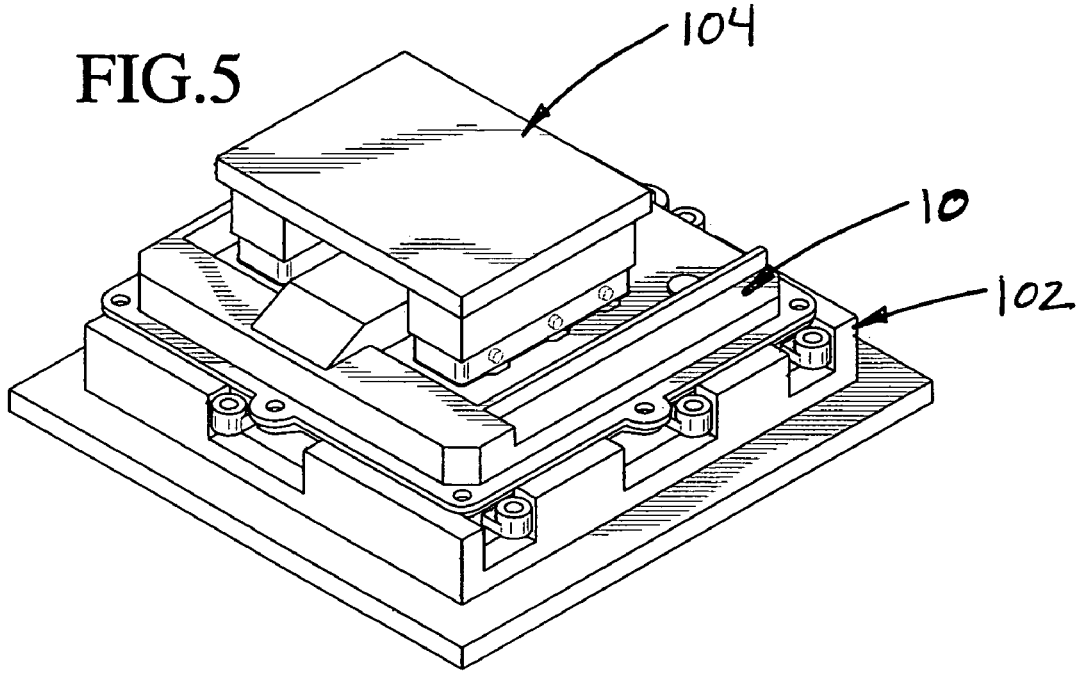
FIG. 5 is a perspective view of the electronic control module positioned between the base and force transmitter of the apparatus of the present invention.

As shown in FIG. 3, force transmitter 104 of apparatus 100 of the present invention includes a cross plate 116 and a plurality of transmitting surfaces 118 positioned on cross plate 116 for transmitting a separation force to connectors 34, 36 and 38. The number of transmitting surfaces 118 corresponds to the total number of connectors, i.e. three. In the exemplary embodiment of FIG. 3, each transmitting surface 118 is mounted on a respective arm extending from cross plate 116. Thus, a first arm 120, a second arm 122 and a third arm 123 each are mounted on, or integrally formed on, one face of cross plate 116 and extend outwardly to form respective transmitting surfaces 118. In the exemplary embodiment, the outer end of each arm includes an annular recess 124 forming the transmitting surfaces 118 which are recessed from larger outer surfaces of each arm. First arm 120 and second arm 122 may alternatively be formed integrally as one arm. Each transmitting surface is preferably sized and shaped to substantially correspond to size and shape of exposed connector surfaces to be contacted by the transmitting surface. In this case, connectors 34, 36 and 38 have a generally rectangular shape with an outer peripheral wall 126 of the connector body forming a recess in which connector pins are positioned. Transmitting surfaces 118 are shaped and sized to correspond to and abut upper edge 128 of peripheral wall 126 while the outer end of each extends into the connector body to provide lateral support without contacting the connector pins of each connector as shown in FIG. 5. Preferably, transmitting surfaces 118 are substantially continuous so as to evenly distribute the separation force over the contact area of each connector. Of course, it should be understood that the arms and the transmitting surfaces 118 may be a variety of other shapes and sizes sufficient to effectively transmit and distribute the separation force across/over the exposed surface of each connector to sufficiently create a substantially uniform pressure on the exposed connection surface so as to effect separation as described hereinbelow without damage to circuit board 32 and its electronic components 31. For example, a connector having an exposed connector surface with a different size or shape than the exemplary embodiment would likely require transmitting surfaces with different sizes and shapes. Preferably, transmitting surfaces 118 apply a force to at least two sides of each connector, and preferably to a connector positioned on each side of a circuit board, to more effectively distribute the force.

Figure 6:
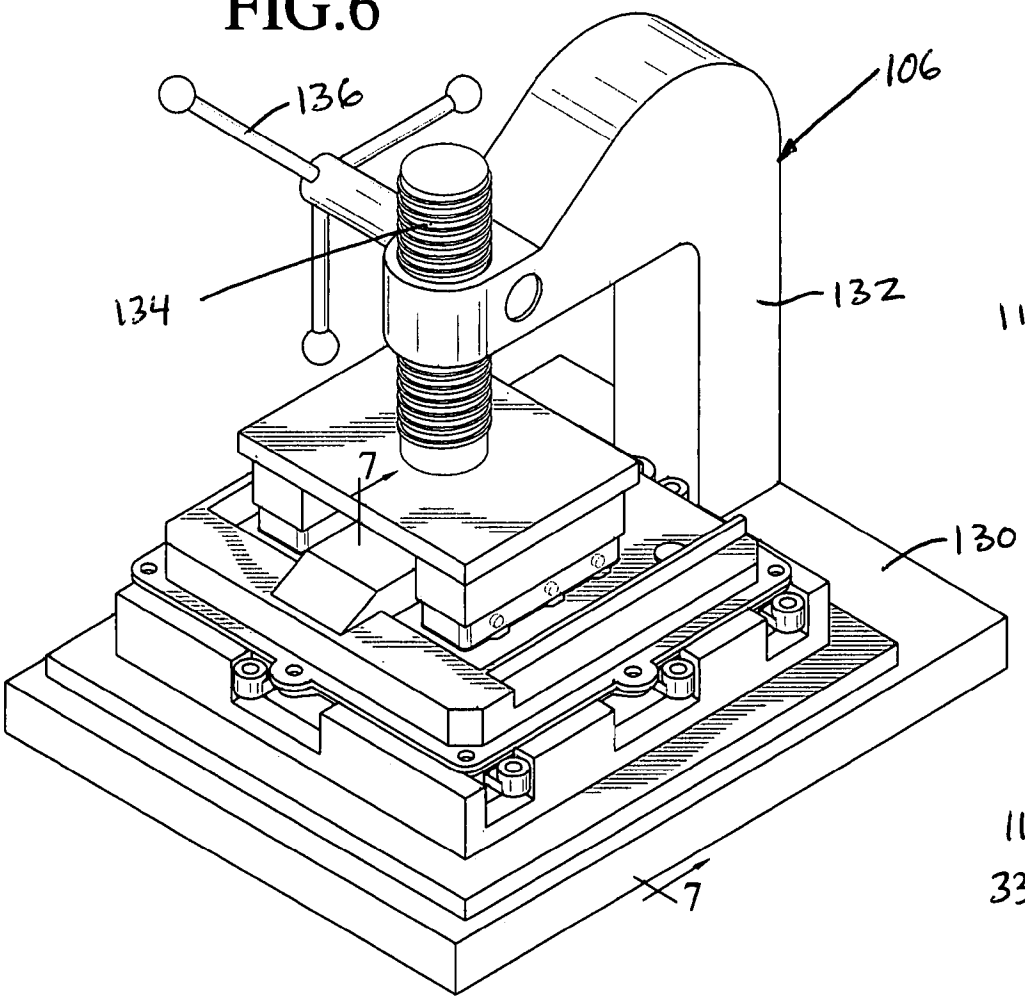
FIG. 6 is a perspective view of the assembly of FIG. 5 positioned on one embodiment of a force applicator of the apparatus of the present invention.

In the exemplary embodiment of the present invention as shown in FIG. 6, force applicator 106 is in the form of an Arbor press. Preferably, the Arbor press includes a support table 130, a force arm 132 mounted on support table 130 and extending therefrom, and a cylindrical ram 134 for abutment against cross plate 116 to apply the separation force to force transmitter 104. A handle 136 is operated in a conventional manner to move ram 134 into engagement with cross plate 116 for applying the primary force. Of course, any other device or machine may be used to apply the force to force transmitter 104. In addition, such a force applicator may be integrally combined with one or both of the force transmitter 104 and base 102.

Figure 1:
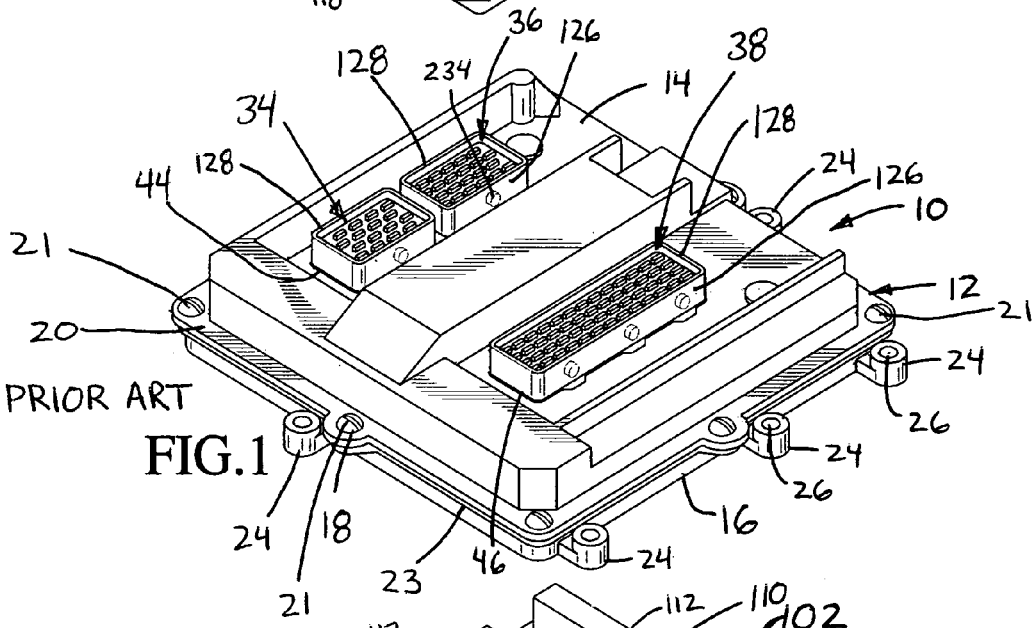
PRIOR ART FIG.1
FIG. 1 is a perspective view of an electronic control module for an engine.
Figure 7:
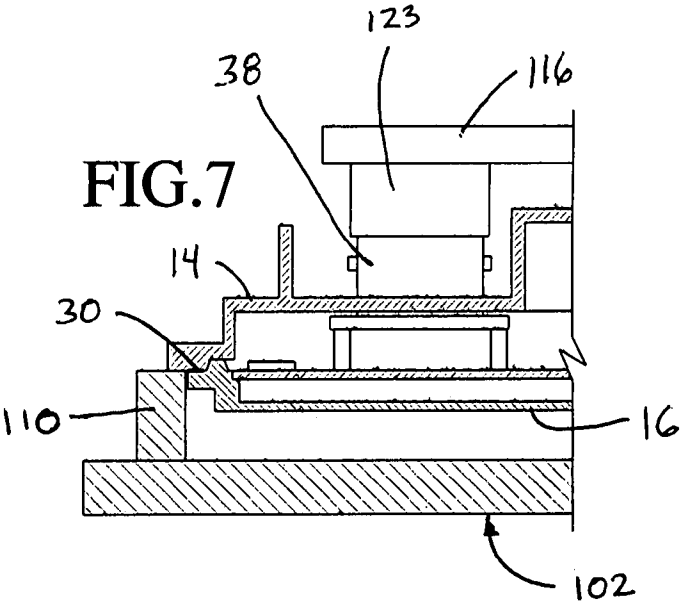
FIG. 7 is a partial cross sectional view taken along lines 7—7 in FIG. 6 before separation of the housing.
Figure 8:
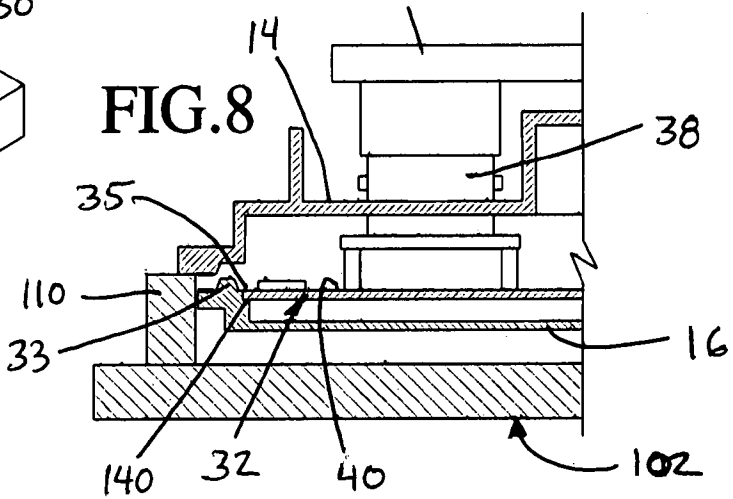
FIG. 8 is a partial cross sectional view similar to FIG. 7 but after separation of the housing.

Using the method of the present invention, first, screws 21 are removed from ECU 10. Of course, sealant bead 30 still securely holds first section 14 and second section 16 together. That is, sealant bead 30 not only seals the inner face between first and second sections 14 and 16 but creates a secure connection especially after curing upon assembly. ECU 10 of FIG. 1 is then placed on base 102 with first section 14 and connectors 34, 36, 38 facing upwardly and with outer flange 20 of first section 14 positioned on, and supported by, support surfaces 112 as shown in FIG. 4. Next, as shown in FIGS. 5 and 7, force transmitter 104 is positioned on ECU 10 with arms 120, 122 and 123 positioned on top of connectors 34, 36 and 38, respectively. In this position, transmitting surfaces 118 on each arm to abut respective exposed connector surfaces, i.e. upper edges 128. Next, if not already in position on force applicator 106, the assembly of force transmitter 104, ECU 10 and base 102 is positioned on support table 130 of force applicator 106 as shown in FIG. 6. Handle 136 is then rotated to move ram 134 toward and into abutment with the top surface of cross plate 116 of force transmitter 104. Handle 136 is then further rotated to cause ram 134 to apply sufficient downward force on force transmitter 104 so that a sufficient separation force is transmitted from the force transmitter 104 to second section 16 of ECU housing 12 via connectors 34, 36 and 38 to break the seal 30 between first section 14 and second section 16. Once the force level on the sealing bead 30 reaches a predetermined level, the sealing bead 30 will fail or break causing second section 16 of housing 12 to disengage first section 14 and move downwardly toward bottom wall 108 of base 102 from the position shown in FIG. 7 to the position shown in FIG. 8.

The force is applied and distributed by transmitting surfaces 118 to exposed upper edges 128 of connectors 34, 36 and 38. Transmitting surfaces 118 are sized and shaped to create a significant contact area with exposed upper edges 128 of the connectors so as to distribute the separation force across edges or surfaces 128 to create substantially uniform pressure on the exposed surface of the connectors. Likewise, the connectors extend over a significant area of the circuit board (FIG. 9) and thus distribute the force over the area of the circuit board without significant bending or flexing of the circuit board 32 thereby avoiding undue stress on the circuit board 32 and its mounted components 31.

It should be noted that the amount of the separation force required to separate second section 16 from first section 14 will vary depending upon various factors including the strength of the connection provided by sealing bead 30. Although the separation force in the present embodiment is applied manually by mechanical operation, an automatic or powered force applicator may be used which may include, for example, a pneumatic, electric or hydraulic operated drive.

Figures 9, 10:
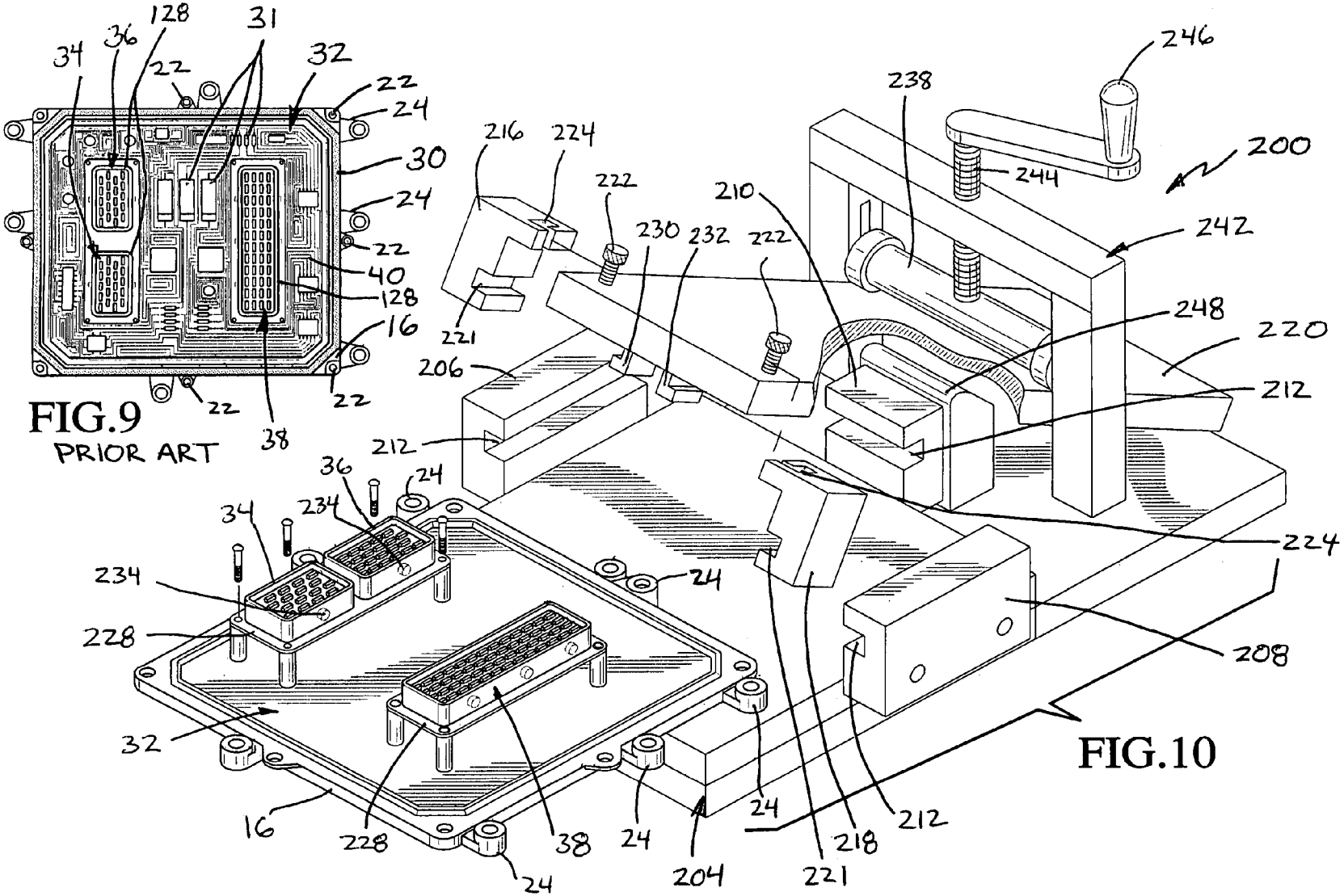
FIG.9 PRIOR ART
FIG. 9 is a top elevational view of the circuit board connected to a bottom section of the module housing after separation from a top section of the module housing.
FIG. 10 is a perspective view of the separator apparatus of the present invention.

FIG. 9 illustrates the circuit board attached to second section 16 after being separated from first section 14 and removed from base 102. Although some diagnostic and repair work may be performed on the circuit board while still attached to second section 16, typically it is desirable to then remove circuit board 32 from second section 16. Circuit board 32 is still securely mounted on second section 16 using an adhesive or sealant placed along the periphery on the bottom face of circuit board 32. Referring to FIG. 10, the present invention also includes a separator apparatus or device 200 for separating circuit board 32 from second section 16 of housing 12. Generally, separator apparatus 200 effectively removes circuit board 32 from second section 16 by applying a pulling force 202 (FIG. 12) to at least one of the connectors 34, 36, 38 and preferably to a connector on each side of the circuit board, while importantly minimizing stress, bending and flexing of circuit board 32 during the process by distributing pulling force 202 across the connectors and thus across a significant portion of circuit board 32.

Separator apparatus 200 includes a base 204 and one or more holding members for holding peripheral flange 23 of second section 16 during the application of pulling force 202. Specifically, apparatus 200 includes a first holding member 206 positioned on one side, a second holding member 208 positioned on a opposite side and a third holding member 210 positioned to receive a third side of second section 16. Each holding member includes a respective slot 212 positioned and sized for receiving peripheral flange 23 of second section 16 without receiving the outer peripheral edge of circuit board 32. In the preferred embodiment, each slot 212 is sized and positioned to receive bosses 24 of flange 23. Each slot 212 is sized sufficiently so that circuit board 32 can be slid into slots 212 as best shown in FIGS. 11 and 12.

As best shown in FIGS. 10 and 11, separator apparatus 200 also includes a pulling element 214 for applying pulling force 202 on connectors 34, 36, 38. Specifically, pulling element 214 includes a first outer pulling bracket 216 and a second outer pulling bracket 218 mounted on a pivot arm 220. Preferably, first and second pulling brackets 216, 218 are adjustably mounted on opposite sides of pivot arm 220 by, for example, adjustment bolts 222 which fit into a respective mounting channel 224 formed in the upper portion of each pulling bracket 216, 218. Each pulling bracket 216, 218 also includes a slot 221 for engaging a portion of a respective connector body. In the exemplary embodiment of FIGS. 10–13, connectors 34 and 36 include a common lower wall 226 while connector 38 includes a lower wall 228. Slot 220 of first outer pulling bracket 216 is positionable to receive the side edge of lower wall 226 of connectors 34, 36 while slot 220 of second outer pulling bracket 218 is positionable to receive the outer edge of lower wall of 228 of connector 38.

Pulling element 214 also includes a first inner bracket 230 and a second inner bracket 232 mounted on the underside of pivot arm 220. In the exemplary embodiment, first and second inner brackets 230, 232 are fixedly mounted on pivot arm 220 in a position to receive guide extensions 234 formed on wall 126 of each connector (FIG. 11). Guide extensions 234 are designed to guide the connecting harness (not shown) into connection with the appropriate connector. Although first and second inner brackets 230, 232 are fixedly mounted on pivot arm 220 in the exemplary embodiment, these brackets may be adjustably mounted. Moreover, in another embodiment, brackets 216, 218, 230, 232 may be sized and positioned to engage other portions of the connectors while still effectively distributing the pulling force across the connector and thus the circuit board.

Figure 13:
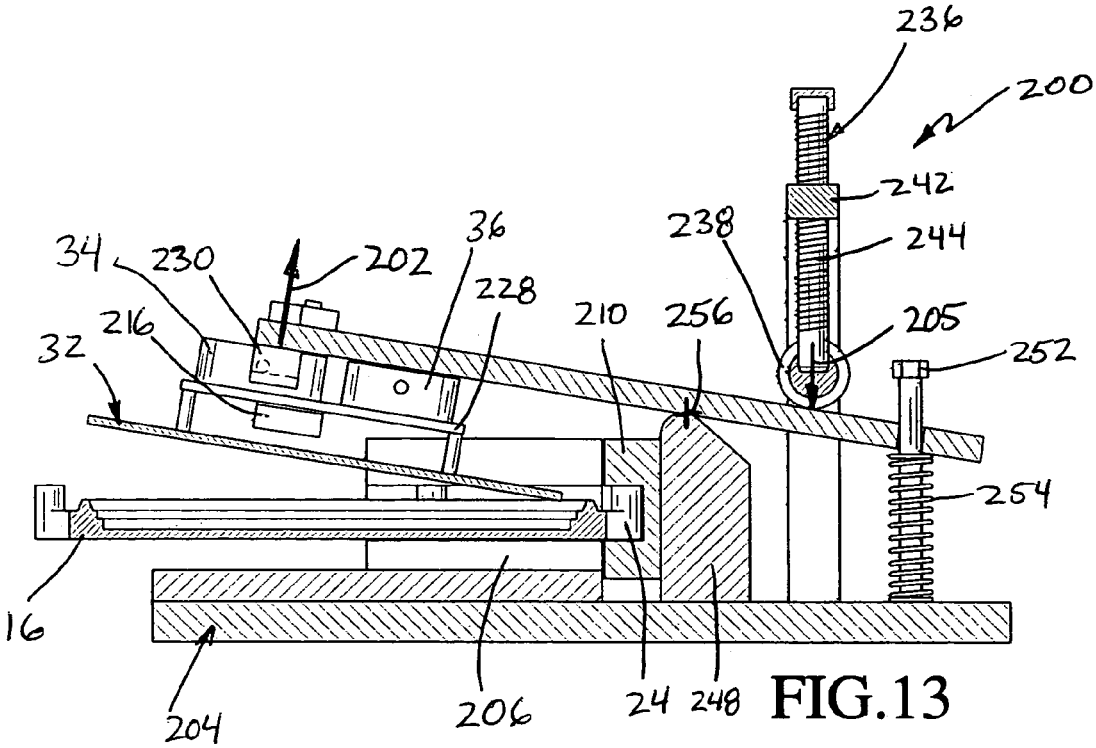
FIG. 13 is a cross sectional view similar to FIG. 12 but after separation of the circuit board from the housing.

Separator apparatus 200 further includes a pulling force driver 236 in the form of a cylinder 238 mounted for vertical movement along grooves 240 formed in opposing surfaces of a support assembly 242. A threaded rod 244 extends upwardly from cylinder 238 through support assembly 242 to engage a handle 246. The lower end of threaded rod 244 bears against cylinder 238 so that clockwise rotation of handle 246 causes downward movement of threaded rod 244 and thus downward movement of cylinder 238 against pivot arm 220 causing cylinder 238 to apply a pivot force 205 to pivot arm 220 (FIG. 13). A fulcrum 248 is mounted on base 204 to support pivot arm 220 along pivot arm 220 between the point of application of pivot force 205 by driver 236 and the engagement point of brackets 216, 218, 230, 232 with the connectors. A return assembly 250 may be provided at one end of pivot arm 220 to return pivot arm 220 to an approximately horizontal position after pivot force 205 has been removed by raising threaded rod 244. Return assembly 250 may include a bolt 252 extending through one end of pivot arm 220 and engaging base 204. A bias spring 254 is positioned around bolt 252 between pivot arm 220 and base 204. Thus as threaded rod 244 moves upwardly as shown in FIG. 13, by a spring 254 pushes one end of pivot arm 220 upwardly causing pivot arm 220 to pivot about a pivot axis 256 as described hereinbelow.

Referring to FIGS. 10–12, during use, the assembly of circuit board 32 and second section 16 is slid into separator apparatus 200 by positioning bosses 24 in respective slots 212 of the various holding members. At the same time, guide extensions 234 are aligned with and slid into the respective slots formed in first and second inner brackets 230, 232. Next, first and second outer pulling brackets 216, 218 are mounted on pivot arm 220 using bolts 222 and mounting channels 224 so that slots 220 engage the side edge of lower wall 226 of the respective connectors. Once the assembly of circuit board 32 and second section 16 is fully installed in separator apparatus 200 as shown in FIGS. 11 and 12, handle 246 is rotated in a clockwise direction causing downward movement of threaded rod 244 and cylinder 238 resulting in pivot force 205 being applied to pivot arm 220 on one side of pivot axis 256. As a result, the opposite end of pivot arm 220 applies pulling force 202 to the connectors 34, 36, and 38 via the brackets 216, 218, 230, 232. When the pulling force 202 reaches a magnitude sufficient to break the adhesive/sealant bond between circuit board 32 and second section 16, circuit board 32 will move upwardly as shown in FIG. 13 while pivot arm 220 pivots around the pivot axis 256. Circuit board 32 may then be slid out of the slots of the brackets and transported for repair, diagnostic work or any other work as desired. Second section 16 is then also slid out from slots 212 of the holding members and discarded or refurbished for reuse.

Figure 14:
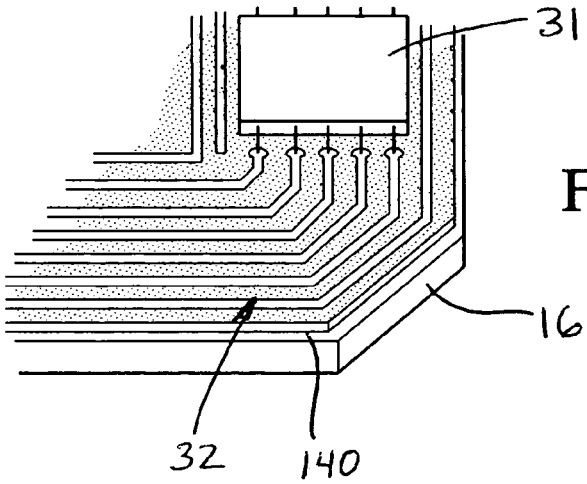
FIG. 14 is a partial perspective view of one corner of the circuit board and housing section after machining of the housing.
Figure 15:
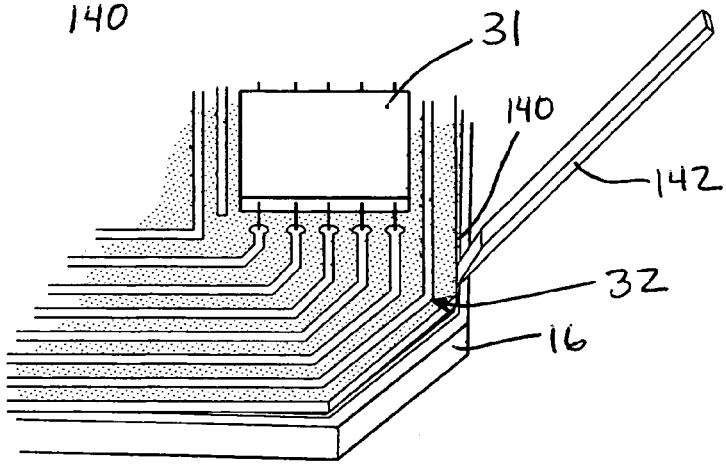
FIG. 15 is a view similar to FIG. 14 but with a spreader tool applied to the joint between the board and housing.

An alternative method for removing circuit board 32 from second section 16 of housing 12 will now be described. As shown in FIGS. 14 and 15, raised wall 33 of second section 16 is positioned immediately adjacent the connection or sealing joint 140 between circuit board 32 and second section 16. Thus, raised wall 33 blocks access to joint 140. The present method of invention includes the step of machining or milling the outer peripheral material of second section 16, including raised wall 33, so as to expose joint 140 as shown in FIG. 14. Thus, the machining or milling step uses a conventional machine to remove the outer peripheral edge of second section 16 to expose joint 140 sufficiently to permit access to joint 140 to enable removal of circuit board 32. Most preferably, a numerically controlled milling machine is utilized to provide precision cutting of the housing without affecting circuit board 32. In the exemplary embodiment, a spreader tool 142 formed with, for example, a tapered or sloped end, is then inserted into joint 140 so as to disrupt or break the seal between circuit board 32 and second section 16 as shown in FIG. 15. In this manner, circuit board 32 can be carefully pried from second section 16 without causing bending or flexing of circuit board 32 thereby avoiding undue stress on the circuit board and its components. Thus, spreader tool 142 not only can be used to disrupt the seal between circuit board 32 and second section 16 but also to slightly apply a force to circuit board 32 which tends to move circuit board 32 away from second section 16. As before, once removed, circuit board 32 may then be modified, replaced and/or tested as desired. Subsequently, the tested or modified circuit board may be secured into a new housing and the first and second sections of the new housing sealed and connected using a sealing bead and screws.

Thus, the apparatus and method of the present invention permits effective removal of circuit board 32 from sealed housing 12 while minimizing bending and flexing of circuit board 32 sufficiently to prevent damage to circuit board 32 and its electronic components 31. The apparatus and method of the present invention effectively distributes the separation force across exposed surfaces of the circuit board 32, i.e. connectors, to create substantially uniform pressure on the connectors and thus the circuit board thereby causing effective transfer of the separation force to second section 16 of housing 12 via circuit board 32 without any damage to circuit board 32 or its electronic components. The method of the present invention also effectively separates circuit board 32 from housing 12 in a simple and cost effective manner while also preventing flexing and undue stress of the circuit board thereby preserving the circuit board for repeated use after testing, modifying and/or replacing components.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. An apparatus for opening a sealed module having a sealed housing formed of a first section and a second section sealingly connected to the first section, and a circuit board mounted on the second section within the housing, the circuit board including at least one connector having an exposed surface accessible from outside the housing, said apparatus comprising:

a base adapted to support the first section of the module housing;

a force transmitter adapted to transmit a separation force to the exposed surface of the at least one connector to separate the second section from the first section, said force transmitter including at least one transmitting surface sized and shaped to distribute the separation force across the exposed surface of the at least one connector to create substantially uniform pressure on the exposed surface of the connector, wherein said base includes a bottom wall and a side wall extending from the bottom wall, said side wall having an upper support surface to support an outer flange of the first section of the housing.

2. The apparatus of claim 1, wherein said base includes a plurality of support surfaces positioned to support only an outer peripheral flange of the first section.

3. The apparatus of claim 1, wherein said at least one transmitting surface is sized and shaped to substantially correspond to a size and shape of the at least one connector.

4. The apparatus of claim 1, wherein said at least one transmitting surface includes a plurality of transmitting surfaces positioned a spaced distance from one another to apply the separation force to a plurality of connectors.

5. The apparatus of claim 4, wherein said plurality of transmitting surfaces are equal in number to a total number of connectors.

6. The apparatus of claim 1, wherein said force transmitter includes a cross plate for receiving a separation force, a first arm extending from said cross plate and a second arm extending from said cross plate a spaced distance from said first arm.

7. The apparatus of claim 6, wherein said first and said second arms extend from one face of said cross plate and said force transmitter has a U-shaped cross-section.

8. The apparatus of claim 1, wherein said force transmitting surface contacts at least two sides of the at least one connector.

9. The apparatus of claim 1, further including a force applicator adapted to apply a force to said force transmitter.

10. An apparatus for opening a sealed module having a sealed housing formed of a first section and a second section sealingly connected to the first section, and a circuit board mounted on the second section within the housing, the circuit board including at least one connector having an exposed surface accessible from outside the housing, said apparatus comprising:

a base means for supporting the first section of the module housing;

a force transmitting means for transmitting a separation force to the exposed surface of the at least one connector sufficient to separate the second section from the first section and for distributing said separation force across the exposed surface of the connector to prevent damage to the circuit board, wherein said base means includes a bottom wall and a side wall extending from the bottom wall, said side wall having an upper support surface to support an outer flange of the first section of the housing.

11. The apparatus of claim 10, wherein said base means includes a plurality of support surfaces positioned to support only an outer peripheral flange of the first section.

12. The apparatus of claim 10, wherein said force transmitting means includes at least one transmitting surface sized and shaped to substantially correspond to a size and shape of the at least one connector.

13. The apparatus of claim 10, wherein said force transmitting means includes a plurality of transmitting surfaces positioned a spaced distance from one another to apply the separation force to a plurality of connectors.

14. The apparatus of claim 10, wherein said force transmitting means includes a cross plate for receiving a separation force, a first arm extending from said cross plate and a second arm extending from said cross plate a spaced distance from said first arm.

15. The apparatus of claim 10, further including a force applicator means for applying a force to said force transmitting means.

16. An apparatus for opening a sealed electronic control module for an engine, the module including a sealed housing formed of a first section and a second section sealingly connected to the first section, and a circuit board mounted on the second section within the housing, the circuit board including a plurality of connectors having exposed surfaces accessible from outside the housing, said apparatus comprising:

a base adapted to support the first section of the module housing;

a force transmitter adapted to transmit a separation force to the exposed surfaces of at least two of the plurality of connectors to separate the second section from the first section, said force transmitter including a plurality of transmitting surfaces positioned a spaced distance from one another, each of said plurality of transmitting surfaces applying separation force to one or more of the at least two connectors of the plurality of connectors, wherein said base includes a bottom wall and a side wall extending from the bottom wall, said side wall having an upper support surface to support an outer flange of the first section of the housing.

17. The apparatus of claim 16, wherein said base includes a plurality of support surfaces positioned to support only an outer peripheral flange of the first section.

18. The apparatus of claim 16, wherein said force transmitter includes at least one transmitting surface sized and shaped to substantially correspond to a size and shape of at least one of the plurality of connectors.

19. The apparatus of claim 16, wherein said force transmitter includes a plurality of transmitting surfaces positioned a spaced distance from one another to apply the separation force to the plurality of connectors.

20. The apparatus of claim 16, wherein said force transmitter includes a cross plate for receiving a separation force, a first arm extending from said cross plate and a second arm extending from said cross plate a spaced distance from said first arm.

21. The apparatus of claim 16, further including a force applicator for applying a force to said force transmitter.

* * * * *